US007665151B1

(12) United States Patent
Finell

(10) Patent No.: US 7,665,151 B1
(45) Date of Patent: Feb. 23, 2010

(54) GARMENT WITH BIB ATTACHMENT

(76) Inventor: Rebecca M. Finell, 1152 E. Cottonwood La., Tempe, AZ (US) 85048

( * ) Notice: Subject to any disclaimer, the term of this patent is extended or adjusted under 35 U.S.C. 154(b) by 0 days.

(21) Appl. No.: 12/182,085

(22) Filed: Jul. 29, 2008

(51) Int. Cl.
*A41B 13/10* (2006.01)
*A41D 11/00* (2006.01)

(52) U.S. Cl. ..... 2/49.1; 2/52; 2/80; 2/111

(58) Field of Classification Search ..... 2/49.1–49.5, 2/111, 48, 51, 52, 119, 120, 46, 75, 80, 83, 2/50, 92, 103, 95, 106, 114, 104; D2/860–864, D2/776
See application file for complete search history.

(56) References Cited

U.S. PATENT DOCUMENTS

| | | | | | |
|---|---|---|---|---|---|
| 487,000 | A * | 11/1892 | Auer | 2/115 |
| 2,035,377 | A * | 3/1936 | Redmond | 2/111 |
| 2,212,719 | A * | 8/1940 | Prouty | 2/93 |
| 2,222,323 | A * | 11/1940 | Sheridan | 2/111 |
| 2,425,635 | A * | 8/1947 | Nitzberg | 2/75 |
| D161,365 | S * | 12/1950 | Parker | D2/841 |
| 2,556,039 | A * | 6/1951 | Landert | 2/106 |
| 2,922,164 | A * | 1/1960 | Liff | 2/49.2 |
| 6,216,269 | B1 * | 4/2001 | Smith et al. | 2/46 |
| 6,408,439 | B1 * | 6/2002 | Garforth-Crippen | 2/80 |
| 2005/0241042 | A1 * | 11/2005 | Frieswick et al. | 2/49.1 |
| 2007/0192924 | A1 * | 8/2007 | Bahm et al. | 2/49.1 |
| 2008/0250541 | A1 * | 10/2008 | Chen | 2/49.1 |

* cited by examiner

*Primary Examiner*—Amy B Vanatta
(74) *Attorney, Agent, or Firm*—Parsons & Goltry; Michael W. Goltry; Robert A. Parsons

(57) ABSTRACT

A garment with bib attachment consists of a garment body having a front, opposed first and second sides, an upper end, a neck-receiving opening formed in the upper end of the garment body, a first arm stall formed in the upper end of the garment body on a first side of the neck-receiving opening, and a second arm stall formed in the upper end of the garment body on a second side of the neck-receiving opening. First and second pockets are formed in the upper end of the garment body on either side of the neck-receiving opening. A bib is formed a first extension extending into the first pocket and a second extension extending into the second pocket. The first and second extensions are detachably secured to the garment within the first and second pockets, respectively, suspending the bib on the front of the garment body under the neck-receiving opening.

13 Claims, 4 Drawing Sheets

GARMENT WITH BIB ATTACHMENT

FIELD OF THE INVENTION

This invention relates generally to clothing and, more particularly, to baby clothing and to bibs of the type attached under a child's chin during mealtime.

BACKGROUND OF THE INVENTION

Feeding a baby is messy business, as it is often fraught with spit-ups, food and drink spills from the baby's mouth, and the throwing of food by the baby. Nevertheless, feeding a baby is often a fun experience for parent and baby alike. Moreover, regardless of how messy mealtime with a baby can be, it is always a satisfying experience if the baby eats well.

Because feeding a baby at mealtime is often messy, most parents and caregivers use bibs to collect food and drink spills from under the baby's chin. Typically, bibs are tied or otherwise secured around the baby's neck to suspend the bib under the baby's chin. Securing or tying a bib around a baby's neck poses a choking hazard and is, therefore, inherently dangerous. Moreover, tying a conventional bib tie around a baby's neck is difficult because the bib tie must be carefully adjusted to ensure the bib is not too tight around the baby's neck. Bibs formed with non-adjustable neck ties are often either too big or too small. Accordingly, the art of bibs of the type attached under a child's chin during mealtime is in need of improvement.

BRIEF SUMMARY OF THE INVENTION

According to the principle of the invention, a garment with bib attachment consist of a garment body having a front, opposed first and second sides, an upper end, a neck-receiving opening formed in the upper end of the garment body, a first arm stall formed in the upper end of the garment body on a first side of the neck-receiving opening, and a second arm stall formed in the upper end of the garment body on a second side of the neck-receiving opening. A bib has opposed upper and lower ends, opposed first and second sides, and opposed first and second extensions formed in the upper end of the bib at the first and second sides, respectively, of the bib. The first and second extensions each extend upwardly relative to the upper end of the bib at the first and second sides, respectively, of the bib. A first engagement assembly detachably secures the first extension to the garment body proximate to the upper end of the garment body on the first side of the neck-receiving opening, and a second engagement assembly detachably secures the second extension to the garment body proximate to the upper end of the garment body on the second side of the neck-receiving opening. The first and second engagement assemblies suspend the bib on the front of the garment body below the neck-receiving opening. The first engagement assembly consists of a first engagement element carried by the first extension of the bib body detachably engaged to a first complemental engagement element carried by the garment body, and the second engagement assembly consists of a second engagement element carried by the second extension of the bib body detachably engaged to a second complemental engagement element carried by the garment body.

According to the principle of the invention, a garment with bib attachment consists of a garment body having a front, opposed first and second sides, an upper end, a neck-receiving opening formed in the upper end of the garment body, a first arm stall formed in the upper end of the garment body on a first side of the neck-receiving opening, and a second arm stall formed in the upper end of the garment body on a second side of the neck-receiving opening. A first opening leading into a first pocket is each formed in the upper end of the garment body between the neck-receiving opening and the first arm stall, and a second opening leading into a second pocket is formed in the upper end of the garment body between the neck-receiving opening and the second arm stall. A bib has opposed upper and lower ends, opposed first and second sides. Opposed first and second extensions are formed in the upper end of the bib at the first and second sides, respectively, of the bib. The first and second extensions each extend upwardly relative to the upper end of the bib at the first and second sides, respectively, of the bib. The first extension of the bib extends into the first pocket through the first opening into the first pocket, and the second extension of the bib extends into the second pocket through the second opening into the first pocket. A first engagement assembly detachably secures the first extension to the garment body within the first pocket, and a second engagement assembly detachably secures the second extension to the garment body within the second pocket. The first and second engagement assemblies suspend the bib on the front of the garment body below the neck-receiving opening. The first pocket is inverted and extends downwardly along the front of the garment body to the first opening, and the second pocket is inverted and extends downwardly along the front of the garment body to the second opening. The first opening into the first pocket extends across the front of the garment body proximate to the upper end of the garment body from proximate to the neck-receiving opening to proximate to the first arm stall formed in the garment body. The second opening into the first pocket extends across the front of the garment body proximate to the upper end of the garment body from proximate to the neck-receiving opening to proximate to the second arm stall formed in the garment body. The first engagement assembly consists of a first engagement element carried by the first extension of the bib body detachably engaged to a first complemental engagement element carried by the garment body in the first pocket. The second engagement assembly consists of a second engagement element carried by the second extension of the bib body detachably engaged to a second complemental engagement element carried by the garment body in the second pocket.

According to the principle of the invention, a garment with bib attachment consists of a bib having opposed upper and lower ends, opposed first and second sides, and opposed first and second extensions formed in the upper end of the bib at the first and second sides, respectively, of the bib. The first and second extensions each extend upwardly relative to the upper end of the bib at the first and second sides, respectively, of the bib. Further included is a garment body having a front, opposed first and second sides, an upper end, a neck-receiving opening formed in the upper end of the garment body, a first arm stall formed in the upper end of the garment body on a first side of the neck-receiving opening, and a second arm stall formed in the upper end of the garment body on a second side of the neck-receiving opening. A first opening leads into a first pocket formed in the upper end of the garment body between the neck-receiving opening and the first arm stall, and a second opening leads into a second pocket formed in the upper end of the garment body between the neck-receiving opening and the second arm stall. Engagement assemblies formed between the first and second extensions of the bib and the first and second pockets of the garment body are provided for detachably securing the first and second extensions to the garment body within the first and second pockets, respectively, for suspending the bib under the neck-receiving opening formed in the garment body. The first pocket is inverted and extends downwardly along the front of the garment body to the first opening, and the second pocket is inverted and extends downwardly along to the front of the garment body to the second opening. The first opening into the first pocket extends across the front of the garment body proximate to the upper end of the garment body from proximate to the neck-receiving opening to proximate to the first arm stall formed in the garment body. The second opening into the first pocket extends across the front of the garment body proximate to the upper end of the garment body from proximate to the neck-receiving opening to proximate to the second arm stall formed in the garment body. The engagement assembly formed between the first extension of the bib and the first pocket of the garment body consists of a first engagement element carried by the first extension of the bib body detachably engageable to a first complemental engagement element carried by the garment body in the first pocket. The engagement assembly formed between the second extension of the bib and the second pocket of the garment body consists of a second engagement element carried by the second extension of the bib body detachably engageable to a second complemental engagement element carried by the garment body in the second pocket.

BRIEF DESCRIPTION OF THE DRAWINGS

Referring to the drawings.

DETAILED DESCRIPTION OF THE INVENTION

Figure 2:
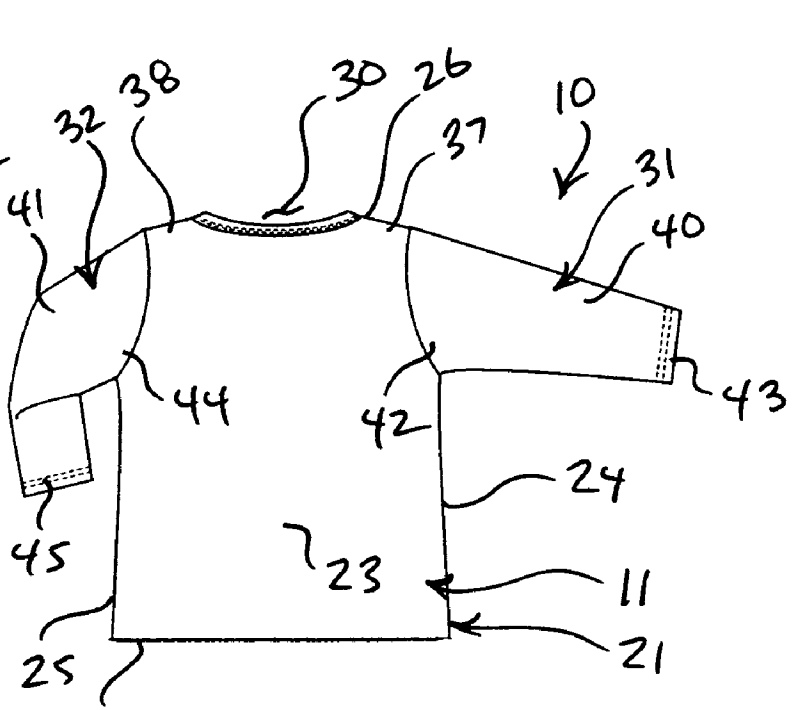
FIG. 2 is a rear view of the garment with bit attached of FIG. 1.
Figure 1:
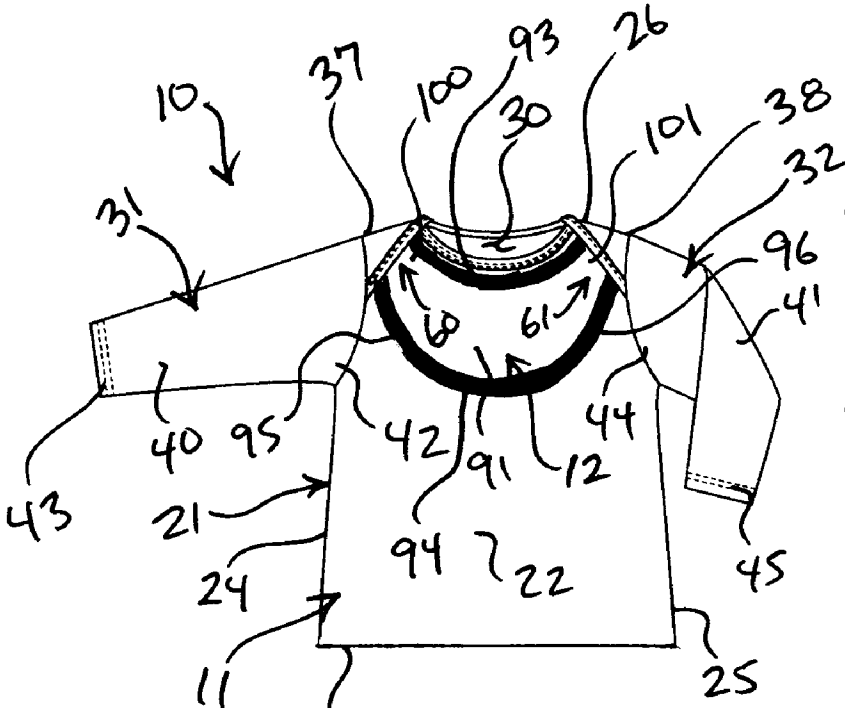
FIG. 1 is a front view of a garment with bib attachment constructed and arranged in accordance with the principle of the invention, the garment with bib attachment consisting of a bib attached to a garment and suspended under a neck-receiving opening formed in an upper end of the garment.

Turning now to the drawings, in which like reference characters indicate corresponding elements throughout the several views, attention is directed in relevant part to FIGS. 1 and 2, in which there is seen front and rear views, respectively, of a garment with bib attachment constructed and arranged in accordance with the principle of the invention and denoted generally with the reference character 10, which includes a garment 11 and a bib 12 attached to garment 11 together forming a garment assembly. In this specific and preferred embodiment, garment 11 consists of a garment body 21 including a front panel or front 22 and an opposed rear panel or back or rear 23, opposed sides 24 and 25, an upper end 26 and an opposed lower end 27, which is open. In this example, side 24 is the right side of garment body 21, and side 25 is the left side of garment body 21. Front and rear 22 and 23, and sides 24 and 25 extend from upper end 26 of garment body 21 to lower end 27 of garment body 21, and together form a volume to receive a torso or trunk of a human baby or child.

A neck-receiving opening 30 is formed in upper end 26 of garment body 21, and opposed arm stalls 31 and 32 are formed in upper end 26 of garment body 21 on either side, respectively, of neck-receiving opening 30. In this example, arm stall 31 is formed proximate to side 24 of garment body 21 and is the right arm stall of garment body 21, and arm stall 32 is formed proximate to side 25 of garment body 21 and is the left arm stall of garment body 21. The region of upper end 26 of garment body 21 between neck-receiving opening 30 and arm stalls 31 and 32, respectively, define the opposed right and left shoulder-covering regions of garment body 21 denoted generally at 37 and 38, respectively.

As illustrated in FIGS. 1 and 2, arm stalls 31 and 32 consist of arm-receiving sleeves 40 and 41. Sleeves 40 and 41 are identical in structure and size and shape. Sleeve 40 has an open proximal end 42 formed in upper end 26 of garment body 21 at side 24 communicating with the volume bound by garment body 21 and extends outwardly and somewhat downwardly from side 24 to an open distal end 43. Sleeve 41 has an open proximal end 44 formed in upper end 26 of garment body 21 at side 25 communicating with the volume bound by garment body 21 and extends outwardly and somewhat downwardly from side 25 to an open distal end 45. Sleeves 40 and 41 are sized and shaped so as to be generally representative of long sleeves. Sleeves 40 and 41 may, if desired, be sized and shaped so as to be generally representative of short sleeves. In a further example, arm stalls 31 and 32 may be formed simply as arm-receiving openings, respectively.

In sum, garment 11 consists of garment body 21 having opposed front 22 and rear 23, opposed sides 24 and 25, opposed upper and lower ends 26 and 27, neck-receiving opening 30 formed in upper end 26 of garment body 21, arm stall 31 formed in upper end 26 of garment body 21 on a first side of neck-receiving opening 30, arm stall 32 formed in upper end 26 of garment body 21 on a second side of neck-receiving opening 30, shoulder-covering region 37 formed in upper end 26 of garment body 21 between neck-receiving opening 30 and arm stall 31, and shoulder-covering region 38 formed in upper end 26 of garment body 21 between neck-receiving opening 30 and arm stall 32. Garment 11 is formed of a soft, pliant fabric, such as a cotton fabric, a polyester fabric, or the like, and is generally representative of a shirt or top sized and shaped to be worn on the upper torso of a human baby or child from birth through two to three years of age. If desired, garment 11 can be formed as part of a bodysuit called a "onesie", which is a term of art and refers to a unitary or assembled body-receiving suit used to cloth human babies and small children.

Garment 10 is used to cloth a human baby or small child. To apply garment 10 to a baby for example, the upper torso of the baby is applied head first into the volume bound by garment body 21 through open lower end 27 in a direction toward upper end 26 of garment body 21, and the head of the baby is applied through neck-receiving opening 30 and the right and left arms of the baby is applied into right and left arm stalls 31 and 32, respectively, completing the installation of garment 10 relative to the baby being exemplary of installation of a shirt to the baby clothing the upper torso of the human baby.

Figure 4:
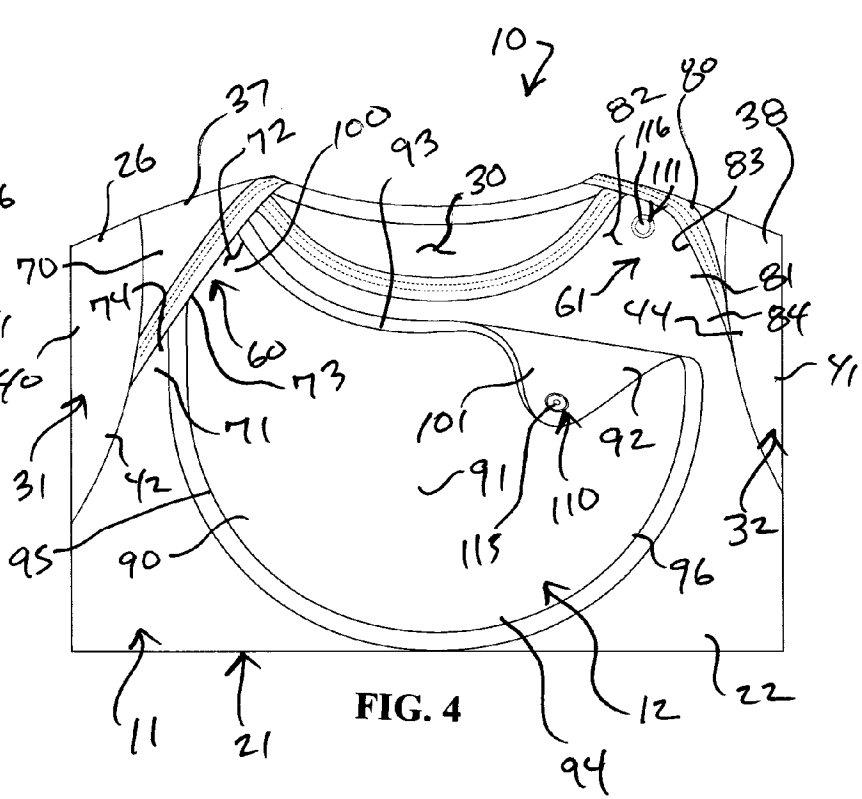
FIG. 4 is a view very similar to that of FIG. 3 illustrating the bib partially detached from the garment.
Figure 3:
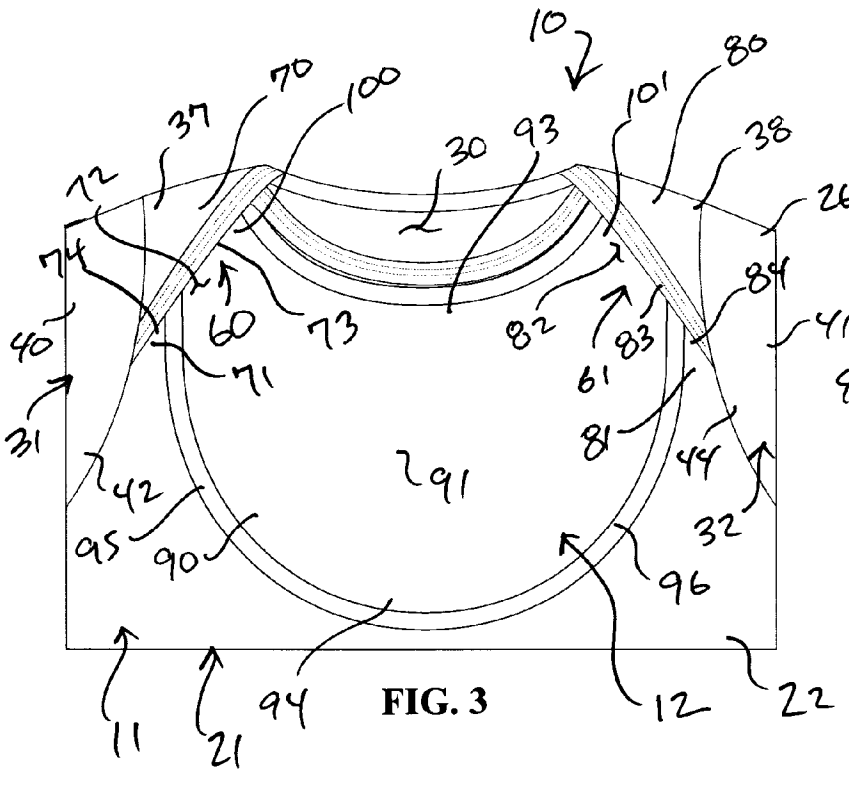
FIG. 3 is an enlarged fragmented front view of the garment with bib attachment of FIG. 1 illustrating the bib suspended from the garment under the neck-receiving opening.

According to the principle of the invention with reference to FIGS. 3 and 4, garment body 21 is formed with opposed pockets 60 and 61. Pocket 60 is formed proximate to shoulder-covering region 37 at upper end 26 of garment body 21 between neck-receiving opening 30 and arm stall 31, and pocket 61 is formed proximate to shoulder-covering region 38 at upper end 26 of garment body 21 between neck-receiving opening 30 and arm stall 32. Pockets 60 and 61 are identical in structure, shape, and size.

Figure 7:
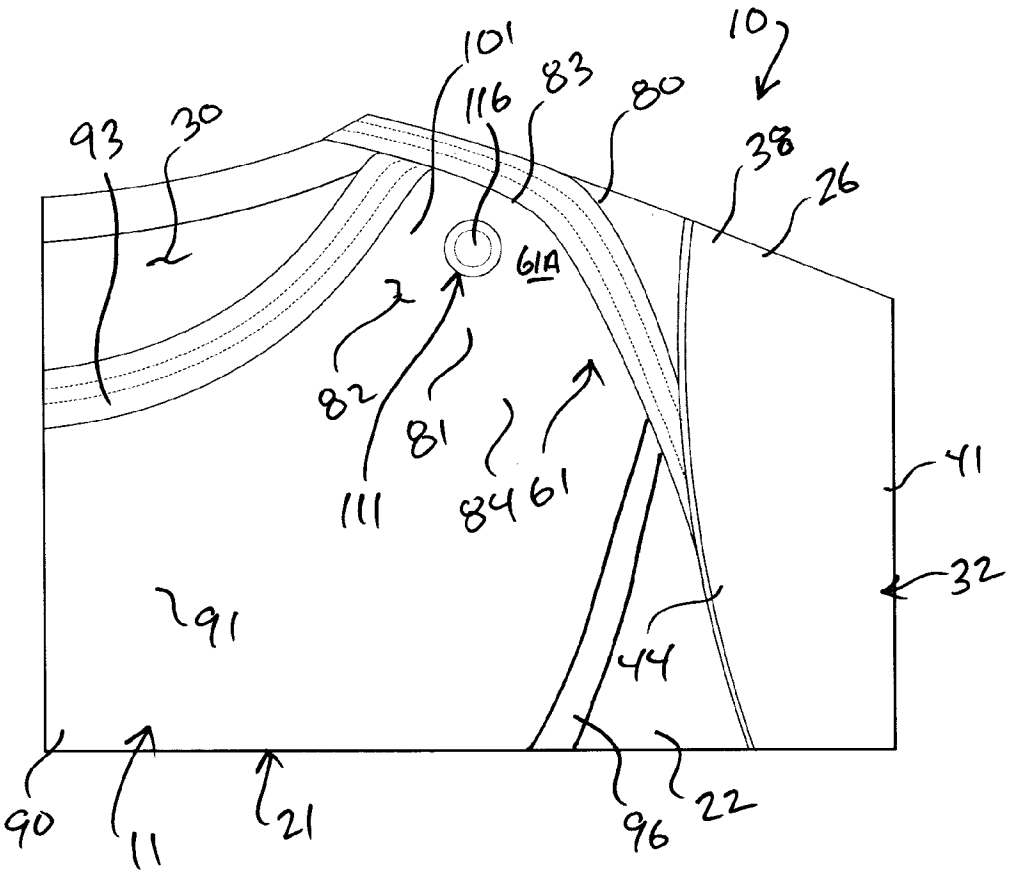
FIG. 7 is an enlarged fragmented front view of the garment body of FIG. 1 illustrating a pocket formed in the upper end of the garment on one side of the neck-receiving opening.

Pocket 60 is formed by a flap 70 formed in garment body 21 in front 22 proximate to shoulder-covering section 37 overlying a corresponding section 71 of front 22. Pocket 60 is inverted, and an opening 72 into pocket 60 is formed between an edge 73 of flap 70 and a corresponding opposed region 74 of front 22 of garment body 21. Opening 72 leads upwardly into volume bound by pocket 60, and extends across front 22 of garment body 21 from proximate to neck-receiving opening 30 to proximate to arm stall 31 as illustrated. Pocket 61 is the mirror image of pocket 60, and is formed by a flap 80 formed in garment body 21 in front 22 proximate to shoulder-covering section 38 overlying a corresponding section 81 of front 22. Like pocket 60, pocket 61 is inverted. With additional reference to FIG. 7, an opening 82 into pocket 61 is formed between an edge 83 of flap 80 and a corresponding opposed region 84 of front 22 of garment body 21. Opening 82 leads upwardly into a volume 61A (referenced only in FIG. 7) bound by pocket 61, and extends across front 22 of garment body 21 from proximate to neck-receiving opening 30 to proximate to arm stall 32 as illustrated. Volume 61A of pocket 61 is referenced in FIG. 7, and it is to be understood that pocket 60 has the same corresponding volume.

Figure 6:
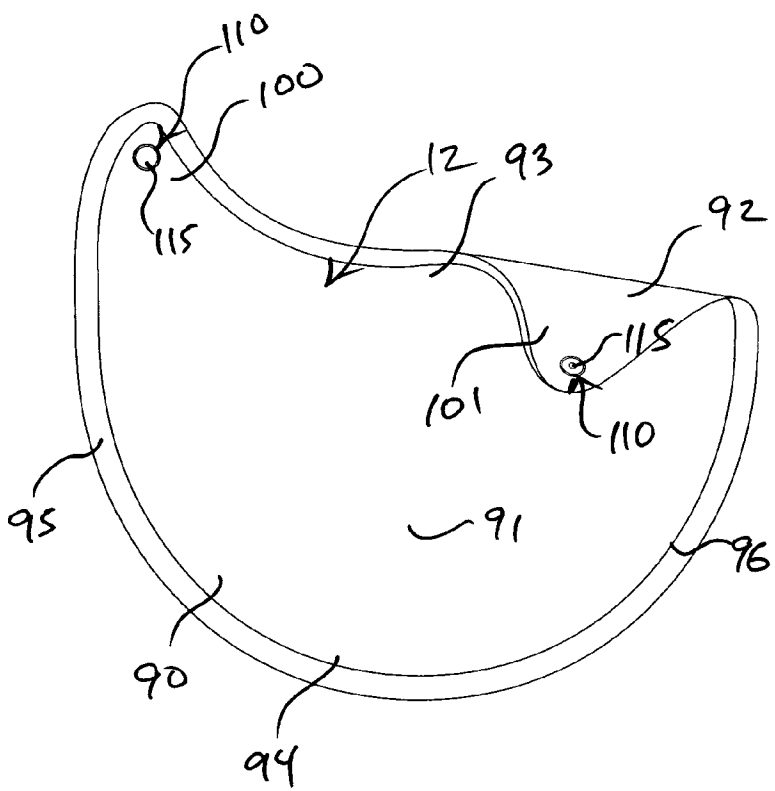
FIG. 6 is a view very similar to that of FIG. 5 illustrating an extension of the bib shown folded downwardly along the front of the bib.
Figure 5:
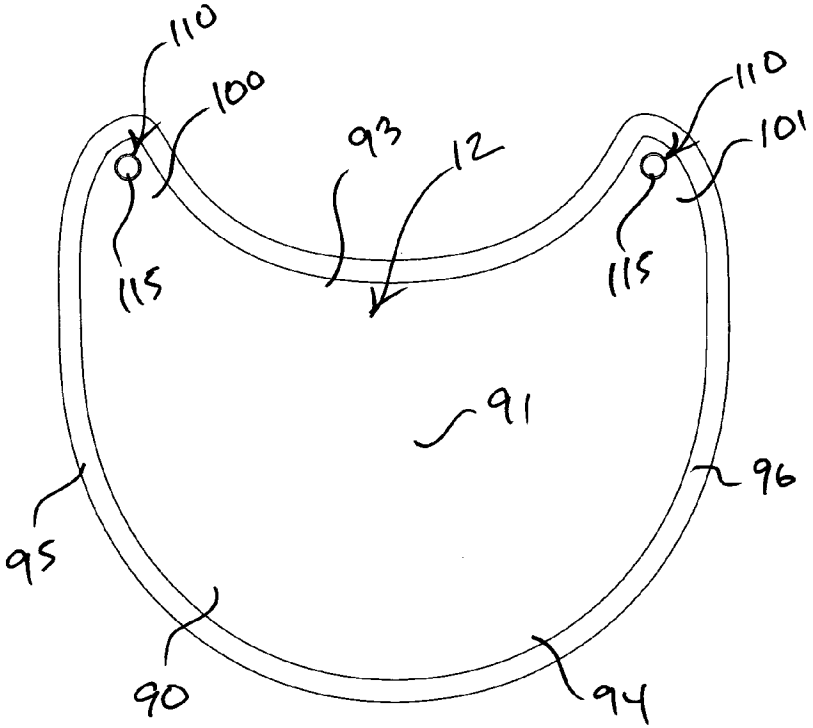
FIG. 5 is a front elevational view of the bib of FIG. 1.

Reference is now made in relevant part to FIGS. 5 and 6, in which there is seen bib 12, which is an apron like cloth formed of cotton or other form of absorbent cloth or cloth-like material or combination of such materials. Bib 12 consists of a broad-flat bib body 90 having opposed major faces 91 and 92, opposed upper and lower ends 93 and 94, and opposed sides 95 and 96 extending between upper and lower ends 93 and 94. Face 91 is considered the outer face of bib 12, face 92 is considered the inner face of bib 12, side 95 is considered the right side of bib 12, and side 96 is considered the left side of bib 12.

As illustrated, bib body 90 is formed with opposed lobes or extensions 100 and 101. Extensions 100 and 101 are substantially equal in size and shape, and are formed in upper end 93 of bib body 90 at opposed sides 95 and 96, respectively, of bib 12. Extensions 100 and 101 each extend upwardly relative to upper end 93 of bib 12 at opposed sides 95 and 96, respectively, of bib 12.

Bib 12 is detachably engageable to garment 10 so as to be positioned across front 22 under neck-receiving opening 30 to collect spilled food and drink from a baby wearing garment 10 during mealtime. To detachably secure bib 12 to garment 10 in accordance with the principle of the invention, face 92 of bib 12 is directed toward front 22 of garment 10 and bib 12 is positioned under neck-receiving opening 30 directing upper end 93 of bib 12 toward neck-receiving opening 30 with bib 12 extending downwardly along front from upper end 93 proximate to neck-receiving opening 30 to lower end 94 of bib 12 and across front 22 of garment 10 from side 95 of bib 12 directed toward side 24 of garment 10 across front 22 of garment 10 to side 96 of bib 12 directed toward side 25 of garment 10. With bib 12 so positioned relative to garment 10, bib 12 is sufficiently sized relative to garment 10 such that extensions 100 and 101 extend upwardly toward pockets 60 and 61, respectively. At this point in the installation of bib 12 to garment 10, extension 100 is passed into pocket 60 through opening 72 and is secured to garment 10 in pocket 60 and extension 101 is passed into pocket 61 through opening 82 and is secured to garment 10 in pocket 61 to suspend bib 12 on front 22 of garment 10 below neck-receiving opening 30, which completes the installation of bib 12 to garment 10 as illustrated in FIGS. 1 and 3, in which bib 12 functions to collect food spills underneath a child's chin wearing garment 10. For illustrative purposes, FIG. 4 illustrates extension 100 passed into pocket 60 through opening 72, and extension 101 prior to installation relative to its corresponding pocket 61.

Engagement assemblies formed between extensions 100 and 101 and garment 10 in pockets 60 and 61, respectively, detachably secure bib 12 to garment 10 to suspend bib 12 on front 22 of garment body 10 below neck-receiving opening 30. The engagement assemblies formed between extensions 100 and 101 of bib 12 and garment 10 in pockets 60 and 61 are identical. Accordingly, only the engagement assembly between pocket 60 and extension 100 will be discussed, with the understanding that the ensuing discussion applies equally to the engagement assembly between pocket 61 and extension 101.

Figure 8:
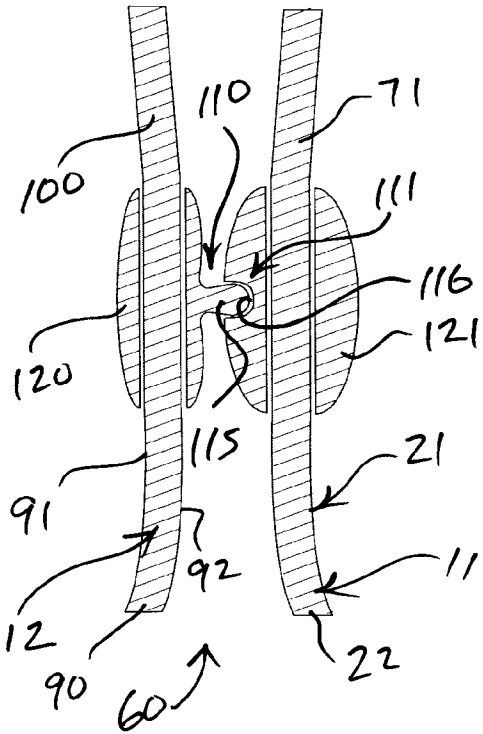
FIG. 8 is a vertical sectional view of an engagement assembly detachably securing an extension of the bib of FIG. 1 to the garment.

FIG. 8 is a vertical sectional view illustrating the engagement assembly formed between pocket 60 and extension 100, which includes an engagement element 110 formed in extension 100 detachably engageable to a complemental engagement element 111 formed in section 71 of front 22 of garment body 21 in pocket 60. If desired, complemental engagement element 111 can be formed in flap 70. In the present embodiment, engagement element 110 is a male snap element 115 of a snap fastener and complemental engagement element is a female snap element 116 of the snap fastener, in which male snap element 115 is snapingly received by and engaged to female snap element 116. In the present embodiment, male snap element 115 is formed in a rivet 120 riveted to extension 100 of bib 12, and female snap element 116 is formed in a rivet 121 riveted to section 71 of front of garment body 21 in pocket 60. To secure male snap element 115 to female snap element 116, extension 100 of bib 12 is simply maneuvered in pocket 60 to register male snap element 115 relative to female snap element 116, and then male and female snap elements 115 and 116 are simply pressed together to snapingly engage male snap element 115 to female snap element 116. To disengage male snap element 115 from female snap element 116 to detach extension of bib 12 from pocket 60, male snap element 115 need only be pulled away from female snap element 116 to detach male snap element 115 from female snap element 116. Although male snap element 115 is formed in extension 100 and female snap element 116 is formed in section 71 of front 22 of garment body 21, this positioning can be reversed if desired.

Male and female snap elements 115 and 116 forming a snap fastener is the preferred form of fastener to secure extensions 100 and 101 to garment body 21 in pockets 60 and 61, respectively. Other forms of engagement assemblies can be used to detachably secure extensions 100 and 101 to garment body 21 in pockets 60 and 61, such as a button fastener, a hook-and-loop fastener of the type found under the trademark VELCRO, or other selected fastener form.

In accordance with the principle of the invention, extension 100 is passed into pocket 60 through opening 72 and is secured to garment 10 in pocket 60 and extension 101 is passed into pocket 61 through opening 82 and is secured to garment 10 in pocket 61 to suspend bib 12 on front 22 of garment 10 below neck-receiving opening 30. Because extensions 100 and 101 are secured to garment 10 in pockets 60 and 61, they are protected in pockets 60 and 61 from being inadvertently detached the flailing hands of a baby being feed during mealtime, in accordance with the principle of the invention. Also, bib 12 is attached to garment 10 without the provision of wrapping and securing bib 12 around the baby's neck, which can pose a choking hazard.

The present invention is described above with reference to a preferred embodiment. However, those skilled in the art will recognize that changes and modifications may be made in the described embodiment without departing from the nature and scope of the present invention. Various further changes and modifications will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A garment with bib attachment, comprising:

a garment body having a front, opposed first and second sides, an upper end, a neck-receiving opening formed in the upper end of the garment body, a first arm stall formed in the upper end of the garment body on a first side of the neck-receiving opening, and a second arm stall formed in the upper end of the garment body on a second side of the neck-receiving opening;

a first opening leading into a first pocket each formed in the upper end of the garment body between the neck-receiving opening and the first arm stall;

a second opening leading into a second pocket each formed in the upper end of the garment body between the neck-receiving opening and the second arm stall;

a bib having opposed upper and lower ends, opposed first and second sides, and opposed first and second extensions formed in the upper end of the bib at the first and second sides, respectively, of the bib, the first and second extensions each extending upwardly relative to the upper end of the bib at the first and second sides, respectively, of the bib;

the first extension of the bib extending into the first pocket through the first opening into the first pocket;

the second extension of the bib extending into the second pocket through the second opening into the second pocket;

first engagement means detachably securing the first extension to the garment body within the first pocket;

second engagement means detachably securing the second extension to the garment body within the second pocket; and the first and second engagement means suspending the bib on the front of the garment body below the neck-receiving opening.

2. The garment with bib attachment according to claim 1, wherein the first pocket is inverted and extends downwardly along the front of the garment body to the first opening.

3. The garment with bib attachment according to claim 2, wherein the second pocket is inverted and extends downwardly along the front of the garment body to the second opening.

4. The garment with bib attachment according to claim 3, wherein the first opening into the first pocket extends across the front of the garment body proximate to the upper end of the garment body from proximate to the neck-receiving opening to proximate to the first arm stall formed in the garment body.

5. The garment with bib attachment according to claim 4, wherein the second opening into the second pocket extends across the front of the garment body proximate to the upper end of the garment body from proximate to the neck-receiving opening to proximate to the second arm stall formed in the garment body.

6. The garment with bib attachment according to claim 5, wherein the first engagement means comprises a first engagement element carried by the first extension of the bib body detachably engaged to a first complemental engagement element carried by the garment body in the first pocket.

7. The garment with bib attachment according to claim 6, wherein the second engagement means comprises a second engagement element carried by the second extension of the bib body detachably engaged to a second complemental engagement element carried by the garment body in the second pocket.

8. A garment with bib attachment, comprising:

a bib having opposed upper and lower ends, opposed first and second sides, and opposed first and second extensions formed in the upper end of the bib at the first and second sides, respectively, of the bib, the first and second extensions each extending upwardly relative to the upper end of the bib at the first and second sides, respectively, of the bib;

a garment body having a front, opposed first and second sides, an upper end, a neck-receiving opening formed in the upper end of the garment body, a first arm stall formed in the upper end of the garment body on a first side of the neck-receiving opening, and a second arm stall formed in the upper end of the garment body on a second side of the neck-receiving opening;

a first opening leading into a first pocket each formed in the upper end of the garment body between the neck-receiving opening and the first arm stall;

a second opening leading into a second pocket each formed in the upper end of the garment body between the neck-receiving opening and the second arm stall;

engagement means for detachably securing the first and second extensions to the garment body within the first and second pockets, respectively, for suspending the bib under the neck-receiving opening formed in the garment body.

9. The garment with bib attachment according to claim 8, wherein the first pocket is inverted and extends downwardly along the front of the garment body to the first opening.

10. The garment with bib attachment according to claim 9, wherein the second pocket is inverted and extends downwardly along the front of the garment body to the second opening.

11. The garment with bib attachment according to claim 10, wherein the first opening into the first pocket extends across the front of the garment body proximate to the upper end of the garment body from proximate to the neck-receiving opening to proximate to the first arm stall formed in the garment body.

12. The garment with bib attachment according to claim 11, wherein the second opening into the second pocket extends across the front of the garment body proximate to the upper end of the garment body from proximate to the neck-receiving opening to proximate to the second arm stall formed in the garment body.

13. The garment with bib attachment according to claim 12, wherein the engagement means comprises:

a first engagement element carried by the first extension of the bib body detachably engageable to a first complemental engagement element carried by the garment body in the first pocket; and a second engagement element carried by the second extension of the bib body detachably engageable to a second complemental engagement element carried by the garment body in the second pocket.

* * * * *